US011220122B2

(12) United States Patent
Arakawa

(10) Patent No.: US 11,220,122 B2
(45) Date of Patent: Jan. 11, 2022

(54) IMAGE RECORDING APPARATUS

(71) Applicant: Brother Kogyo Kabushiki Kaisha, Nagoya (JP)

(72) Inventor: Yuta Arakawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/794,561

(22) Filed: Feb. 19, 2020

(65) Prior Publication Data

US 2020/0276844 A1 Sep. 3, 2020

(30) Foreign Application Priority Data

Feb. 28, 2019 (JP) ..... JP2019-036088

(51) Int. Cl.
*B41J 25/00* (2006.01)
*B41J 19/20* (2006.01)
*B41J 19/18* (2006.01)

(52) U.S. Cl.
CPC ..... *B41J 25/006* (2013.01); *B41J 19/18* (2013.01); *B41J 19/202* (2013.01); *B41J 19/207* (2013.01)

(58) Field of Classification Search
CPC ..... B41J 25/006; B41J 19/207; B41J 19/202; B41J 19/18
See application file for complete search history.

(56) References Cited

U.S. PATENT DOCUMENTS 9,365,059 B2 6/2016 Matsuura et al.
2015/0183239 A1 7/2015 Matsuura et al.

FOREIGN PATENT DOCUMENTS

JP 2008-080669 A 4/2008
JP 2008080669 A * 4/2008 ..... B41J 19/18
JP 2015-126690 A 7/2015

* cited by examiner

*Primary Examiner* — Yaovi M Ameh
(74) *Attorney, Agent, or Firm* — Banner & Witcoff, Ltd.

(57) ABSTRACT

A carriage is configured to move by receiving driving force from a carriage motor. A recording head is mounted on the carriage. A controller is configured to: control a power supply to supply a first driving current to a drive target, the first driving current being variable; when a second driving current for driving the carriage motor does not exceed a limiting current, control the power supply to supply the second driving current to the carriage motor, the second driving current being variable, the limiting current being obtained by subtracting the first driving current from an allowable current of the power supply; and when the second driving current exceeds the limiting current, control the power supply to supply a limited second driving current to the carriage motor, the limited second driving current being obtained by cutting a part of the second driving current, the part exceeding the limiting current.

16 Claims, 9 Drawing Sheets

IMAGE RECORDING APPARATUS

CROSS REFERENCE TO RELATED APPLICATIONS

This application claims priority from Japanese Patent Application No. 2019-036088 filed Feb. 28, 2019. The entire content of the priority application is incorporated herein by reference.

TECHNICAL FIELD

This disclosure relates to an image recording apparatus configured to record an image on a sheet.

BACKGROUND

An image recording apparatus normally includes a plurality of drive targets (such as a motor for driving a roller). In terms of increasing the velocity of image recording, it may be preferable to simultaneously drive the plurality of drive targets.

For example, as an example of the image recording apparatus, an inkjet recording apparatus is known which ejects ink droplets from nozzles provided in a head so as to record an image on a sheet. The inkjet recording apparatus alternately performs an operation of conveying the sheet by a particular length with a roller and an operation of recording in which ink droplets are ejected from the head while a carriage on which the head is mounted is being moved. In terms of increasing the velocity of image recording, it is preferable to simultaneously perform a part of the driving of the roller and a part of the movement of the carriage.

It is required to lower the cost of a power supply which allows a current to flow through the drive targets such as a motor for rotating the roller and a motor for moving the carriage. However, if the cost of the power supply is lowered, the allowable current of the power supply is lowered. Then, when currents simultaneously pass through the drive targets, it is highly likely that the current exceeds the allowable current.

Hence, when the plurality of drive targets are simultaneously driven, measures are taken to monitor the current for each of the drive targets so as to stop the drive target in which the current exceeds a particular threshold value.

SUMMARY

According to one aspect, this specification discloses an image recording apparatus. The image recording apparatus includes a power supply, a drive target, a carriage motor, a carriage, a recording head, and a controller. The carriage is configured to move by receiving driving force from the carriage motor. The recording head is mounted on the carriage. The controller is configured to: control the power supply to supply a first driving current to the drive target, the first driving current being variable; when a second driving current for driving the carriage motor does not exceed a limiting current, control the power supply to supply the second driving current to the carriage motor, the second driving current being variable, the limiting current being obtained by subtracting the first driving current from an allowable current of the power supply; and when the second driving current exceeds the limiting current, control the power supply to supply a limited second driving current to the carriage motor, the limited second driving current being obtained by cutting a part of the second driving current, the part exceeding the limiting current.

BRIEF DESCRIPTION OF THE DRAWINGS

Embodiments in accordance with this disclosure will be described in detail with reference to the following figures wherein.

DETAILED DESCRIPTION

When the current which flows through a drive target is not constant, it is difficult to estimate an accurate current value. Hence, the particular threshold value described above needs to be set to be a low value with consideration given to variations in the estimated value of the current. Consequently, a plurality of motors cannot be driven such that the performance of the power supply is effectively used.

In view of the foregoing, an example of an object of this disclosure is to provide an image recording apparatus configured to drive a plurality of drive targets by efficiently using performance (capacity) of a power supply.

Some aspects of this disclosure will be described while referring to the attached drawings.

In the following description, an upper-lower direction Z is defined in a state where an MFP (multifunction peripheral) 10 is placed in an orientation in which the MFP 10 is intended to be used (the state of FIG. 1), a front-rear direction Y is defined by defining a surface formed with an opening 13 as a front surface 23, and a left-right direction X is defined in a state where the MFP 10 is viewed from the front. The upper-lower direction Z, the front-rear direction Y, and the left-right direction X are perpendicular to each other.

[Overall Structure of MFP 10]

Figure 1:
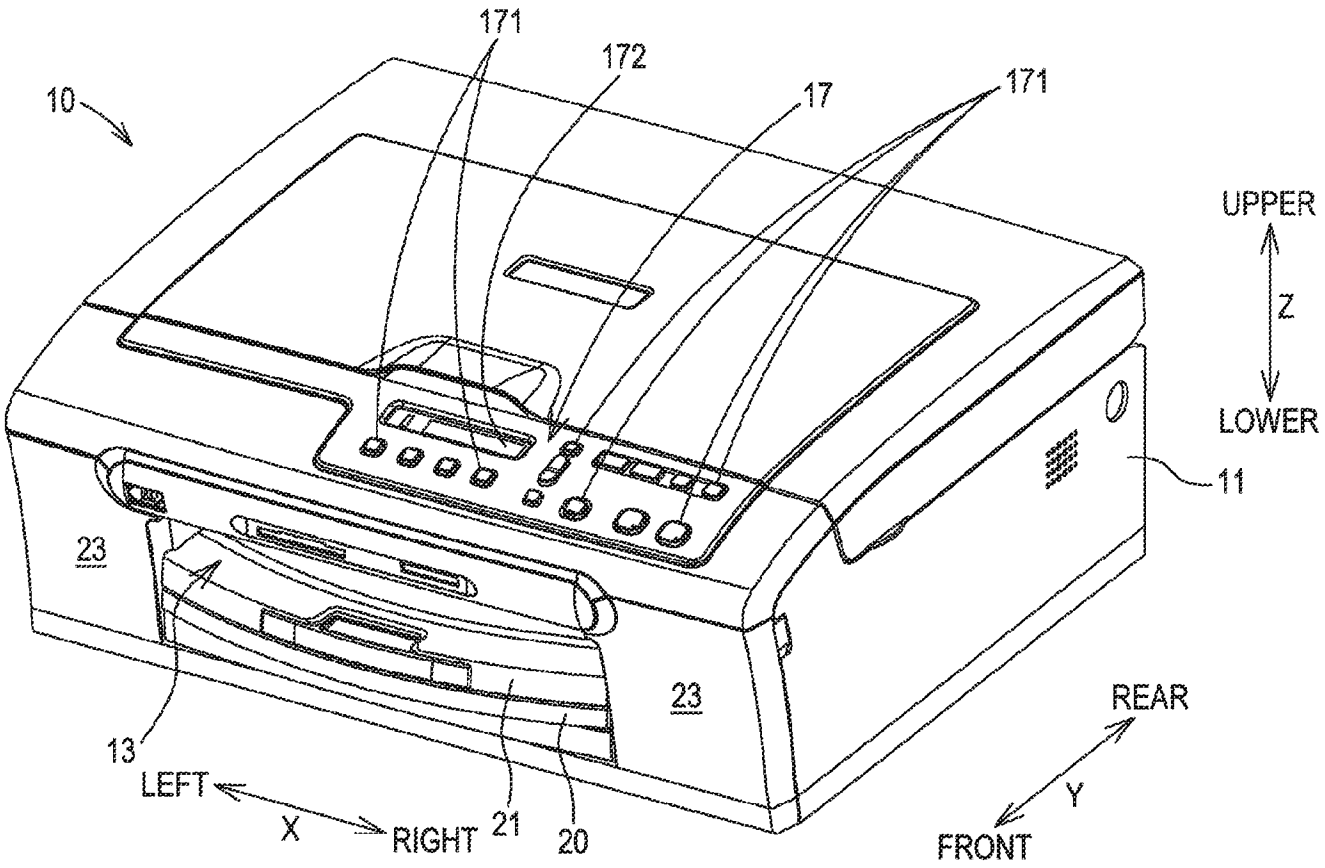
FIG. 1 is a perspective view of a multifunction peripheral (MFP) 10 according to an embodiment.

As shown in FIG. 1, the MFP 10 (an example of an image recording apparatus) is substantially formed as a rectangular parallelepiped. The MFP 10 includes a printer unit 11 at a lower part thereof. The MFP 10 has various functions such as a scanner function, a facsimile function, and a print function. As the print function, the MFP 10 has a function of recording an image on one side of paper 12 (see FIG. 2, an example of a sheet) with an inkjet method. The MFP 10 may be configured to record images on both sides of paper 12. An operation interface 17 is disposed at the upper part of the printer unit 11. The operation interface 17 includes buttons 171 that are operated for instructing image recording and various settings and a liquid crystal display 172 that displays various kinds of information, and so on.

Figure 2:
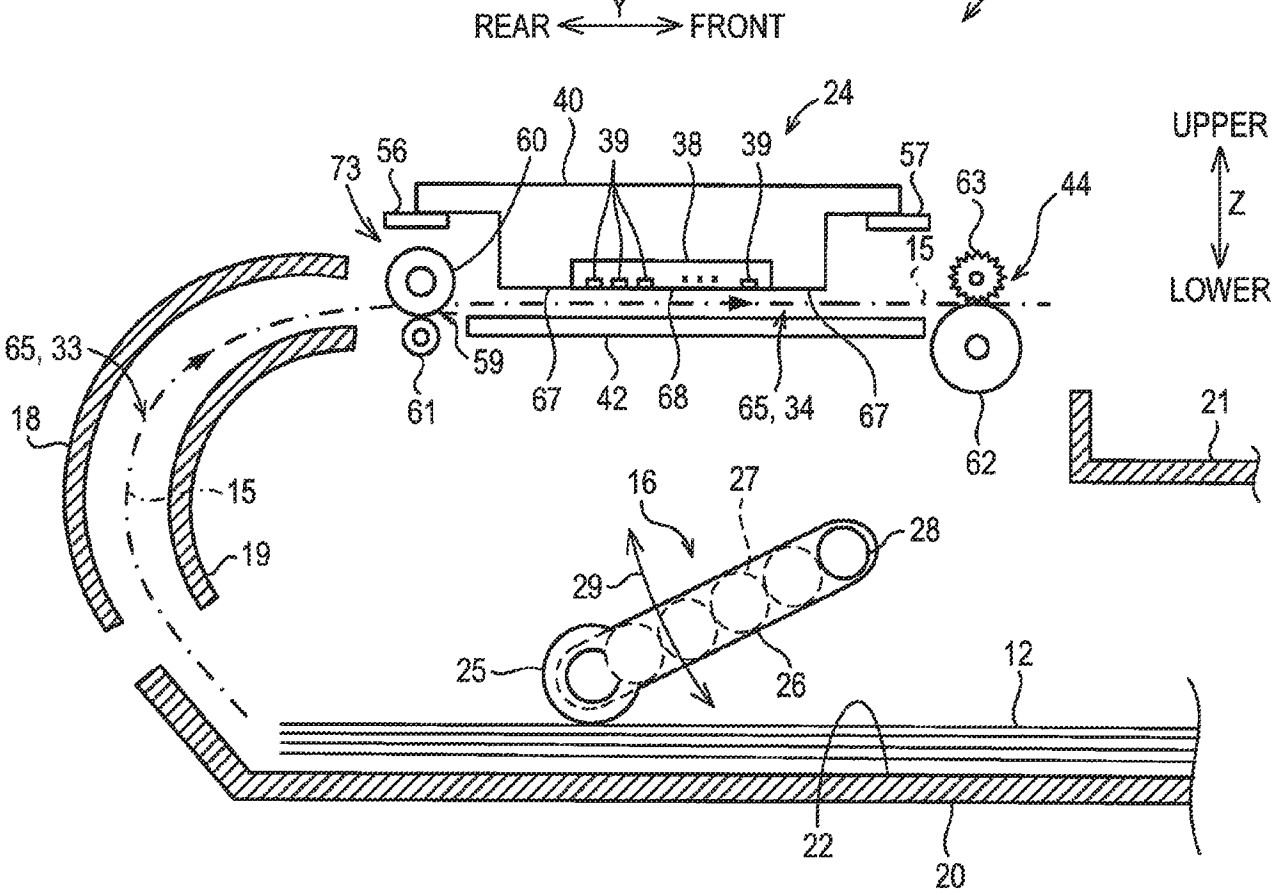
FIG. 2 is a vertical cross-sectional view schematically showing the internal structure of a printer unit 11.
Figure 4:
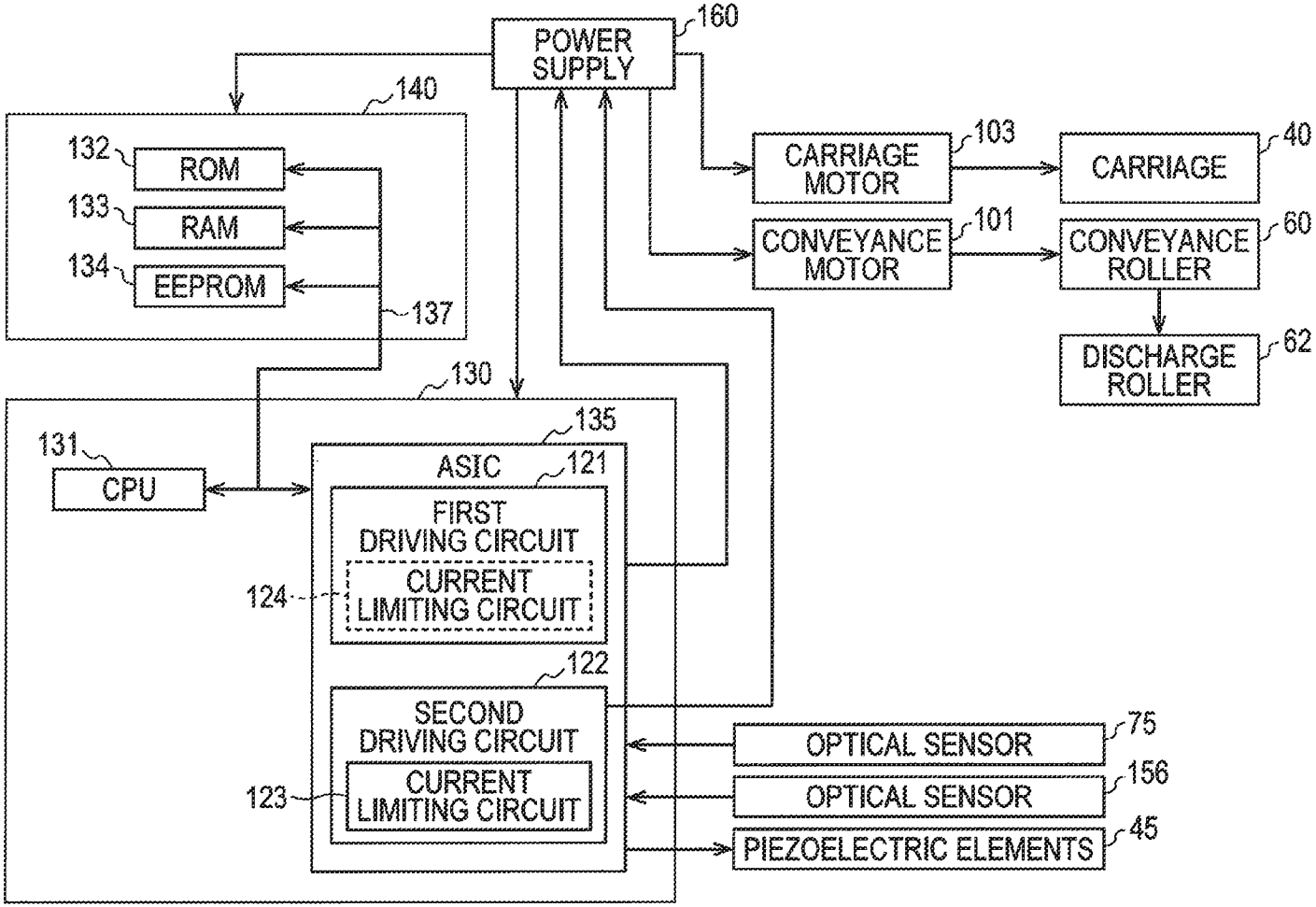
FIG. 4 is a functional block diagram of the MFP 10.

As shown in FIG. 2, the printer unit 11 includes a feed tray 20, a feed unit 16, an outer guide member 18, an inner guide member 19, a platen 42, a recording unit 24, a pair of conveyance rollers 59, a pair of discharge rollers 44, a rotary encoder (not shown), a power supply 160 (see FIG. 4), a controller 130 (see FIG. 4), and a memory 140 (see FIG. 4).

[Feed Tray 20]

As shown in FIG. 1, an opening 13 is formed in the front side of the printer unit 11. The feed tray 20 is configured to be inserted into and removed from the printer unit 11 through the opening 13 by moving in the front-rear direction Y. The feed tray 20 is a box-shaped member in which the upper side is opened, and accommodates paper 12. As shown in FIG. 2, sheets of paper 12 are supported by a bottom plate 22 of the feed tray 20 in a stacked state. A discharge tray 21 is disposed above the front part of the feed tray 20. The upper surface of the discharge tray 21 supports paper 12 that is discharged after an image is recorded thereon by the recording unit 24.

[Feed Unit 16]

As shown in FIG. 2, the feed unit 16 is disposed below the recording unit 24 and above the bottom plate 22 of the feed tray 20. The feed unit 16 includes a feed roller 25, a feed arm 26, a drive transmission mechanism 27, and a shaft 28. The feed roller 25 is rotatably supported at the distal end of the feed arm 26. The feed arm 26 pivotally moves about the shaft 28 provided at the base end in the direction of an arrow 29. With this configuration, the feed roller 25 is configured to make contact with and separate from the feed tray 20 or paper 12 supported on the feed tray 20.

Driving force of a feed motor (not shown) is transmitted to the feed roller 25 due to the drive transmission mechanism 27 including a plurality of gears engaged with one another, and thereby the feed roller 25 rotates. With this configuration, the topmost paper 12 in contact with the feed roller 25, out of paper 12 supported on the bottom plate 22 of the feed tray 20, is fed to a conveyance path 65. Alternatively, the drive transmission mechanism 27 may be a belt looped around the shaft 28 and the shaft of the feed roller 25, for example, instead of the plurality of gears engaged with one another.

Alternatively, the feed roller 25 may receive driving force of a conveyance motor 101 described later and rotate. In this case, the transmission path of driving force from the conveyance motor 101 to each roller is configured to be switchable.

[Conveyance Path 65]

As shown in FIG. 2, the conveyance path 65 extends from the rear end of the feed tray 20. The conveyance path 65 includes a curved portion 33 and a linear portion 34. The curved portion 33 extends upward and makes a U-turn from the rear toward the front. The linear portion 34 extends substantially along the front-rear direction Y.

The curved portion 33 is formed by the outer guide member 18 and the inner guide member 19 that face each other with a particular interval therebetween. Each of the outer guide member 18 and the inner guide member 19 extends in the left-right direction X that is perpendicular to the drawing surface of FIG. 2. The linear portion 34 is formed by the recording unit 24 and the platen 42 that face each other with a particular interval therebetween at a position where the recording unit 24 is disposed.

The paper 12 supported on the feed tray 20 is conveyed through the curved portion 33 by the feed roller 25 and reaches the pair of conveyance rollers 59 described later. The paper 12 nipped by the pair of conveyance rollers 59 is conveyed forward through the linear portion 34 toward the recording unit 24. The recording unit 24 records an image on the paper 12 having reached to a position directly below the recording unit 24. The paper 12 on which an image has been recorded is conveyed forward through the linear portion 34, and is discharged onto the discharge tray 21. As described above, paper 12 is conveyed along a conveyance direction 15 indicated by the single-dot chain line in FIG. 2.

[Platen 42]

As shown in FIG. 2, the platen 42 is disposed at the linear portion 34 of the conveyance path 65. The platen 42 faces the recording unit 24 in the upper-lower direction Z. The platen 42 supports, from below, the paper 12 that is conveyed along the conveyance path 65.

[Recording Unit 24]

As shown in FIG. 2, the recording unit 24 is disposed above the linear portion 34. The recording unit 24 includes the carriage 40 and a recording head 38.

The carriage 40 is supported by the two guide rails 56, 57 disposed with an interval in the front-rear direction Y such that the carriage 40 moves along the left-right direction X perpendicular to the conveyance direction 15. The carriage 40 moves in the left-right direction X such that a lower surface 67 of the carriage 40 and a lower surface 68 of the recording head 38 face the platen 42 in the upper-lower direction Z. Alternatively, instead of the left-right direction X, the movement direction of the carriage 40 may be a direction parallel to the upper surface of the platen 42 and intersecting the conveyance direction 15.

The guide rail 56 is disposed upstream of the recording head 38 in the conveyance direction 15. The guide rail 57 is disposed downstream of the recording head 38 in the conveyance direction 15. The guide rails 56, 57 are supported by a pair of side frames (not shown) arranged outside the linear portion 34 of the conveyance path 65 in the left-right direction X. The carriage 40 is configured to move by receiving driving force from a carriage motor 103 (see FIG. 4).

Figure 3:
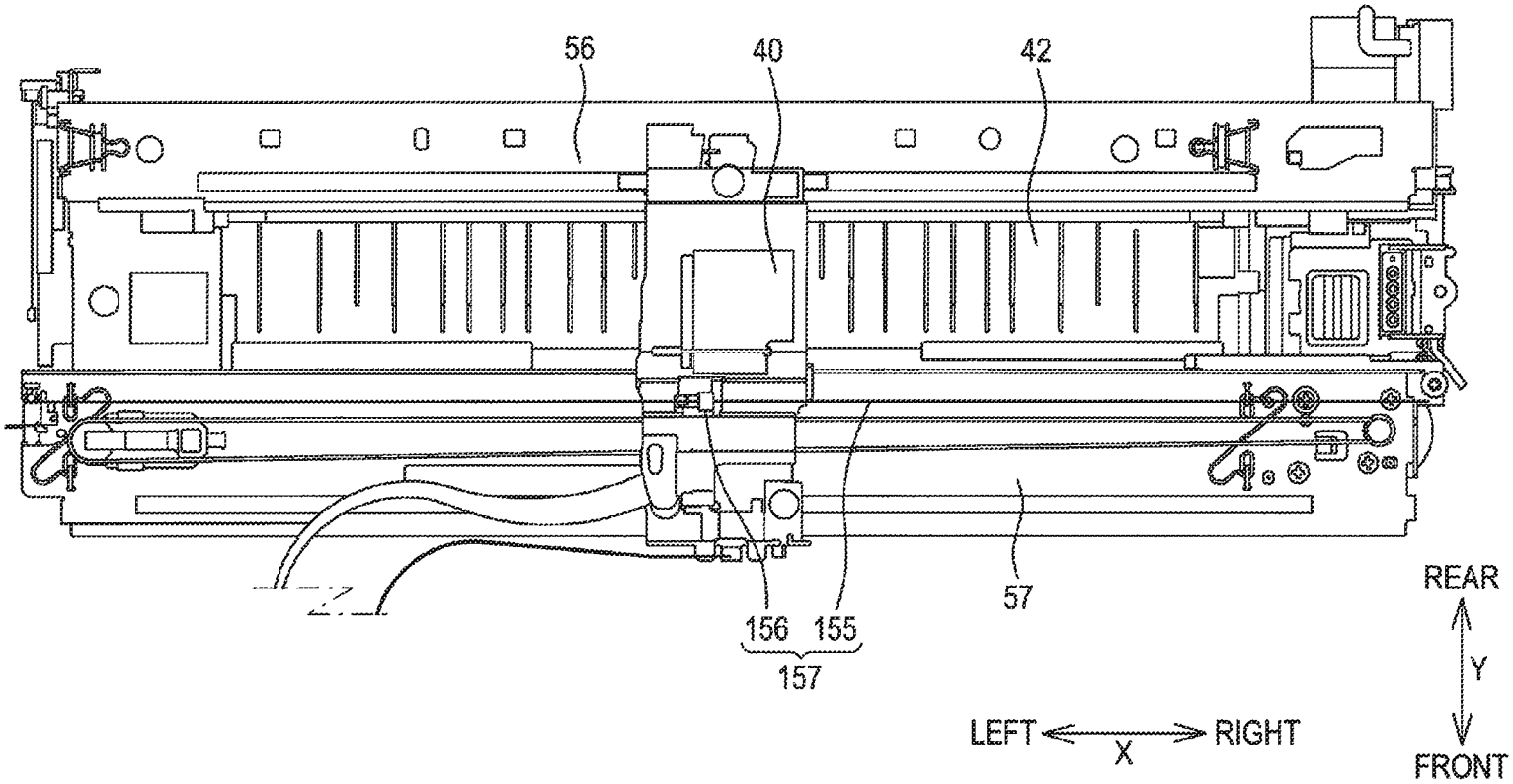
FIG. 3 is a plan view of a carriage 40 and guide rails 56, 57.

As shown in FIG. 3, an encoder strip 155 is arranged at the guide rail 57. The encoder strip 155 is a belt-shaped member made of transparent resin. The right and left end portions of the encoder strip 155 are engaged with support ribs (not shown), and thereby the encoder strip 155 is provided to bridge in the left-right direction X.

The encoder strip 155 has a pattern that a light transmission portion allowing light to transmit and a light blocking portion blocking light are arranged alternately at an equal pitch in the lengthwise direction. An optical sensor 156 that is a transmission-type sensor is provided at a position corresponding to the encoder strip 155 of the carriage 40. A linear encoder 157 for detecting the position of the carriage 40 is formed by the encoder strip 155 and the optical sensor 156. The optical sensor 156 reads the encoder strip 155 and generates a pulse signal in the process of movement of the carriage 40, and outputs the generated pulse signal to the controller 130 (see FIG. 4). As the amount of movement of the carriage 40 is larger, the generated pulse signal becomes longer. That is, the linear encoder 157 outputs a signal depending on the amount of movement of the carriage 40.

As shown in FIG. 2, the recording head 38 is mounted on the carriage 40. The recording head 38 includes a plurality of subsidiary tanks (not shown), a plurality of nozzles 39, ink channels (not shown), and piezoelectric actuators 45 (see FIG. 4).

The plurality of nozzles 39 opens in the lower surface 68 of the recording head 38. The ink channels connect the plurality of subsidiary tanks with the plurality of nozzles 39. The piezoelectric actuators 45 shown in FIG. 4 causes a part of the ink channels to deform, thereby causing ink droplets to be ejected from the nozzles 39. The piezoelectric actuators 45 operate by being supplied with electric power by the controller 130 (see FIG. 4). Due to ejection of ink droplets, an image is recorded on paper 12.

[Pair of Conveyance Rollers 59 and Pair of Discharge Rollers 44]

As shown in FIG. 2, the pair of conveyance rollers 59 is disposed at the linear portion 34 upstream of the recording head 38 and the platen 42 in the conveyance direction 15. The pair of discharge rollers 44 is disposed at the linear portion 34 downstream of the recording head 38 and the platen 42 in the conveyance direction 15.

The pair of conveyance rollers 59 includes a conveyance roller 60 (an example of a roller) and a pinch roller 61 disposed to face the conveyance roller 60 below the conveyance roller 60. The pinch roller 61 is pressed against the conveyance roller 60 by an elastic member such as a coil spring (not shown). The pair of conveyance rollers 59 is configured to nippingly hold paper 12.

The pair of discharge rollers 44 includes a discharge roller 62 and a spur roller 63 disposed to face the discharge roller 62 above the discharge roller 62. The spur roller 63 is pressed against the discharge roller 62 by an elastic member such as a coil spring (not shown). The pair of discharge rollers 44 is configured to nippingly hold paper 12.

Each of the conveyance roller 60 and the discharge roller 62 receives driving force from the conveyance motor 101 (an example of a drive target, see FIG. 4) and thereby rotates. When the conveyance roller 60 rotates in a state where the pair of conveyance rollers 59 nippingly holds paper 12, the paper 12 is conveyed in the conveyance direction 15 by the pair of conveyance rollers 59, and is conveyed onto the platen 42, that is, to a position facing the recording head 38. When the discharge roller 62 rotates in a state where the pair of discharge rollers 44 nippingly holds paper 12, the paper 12 is conveyed in the conveyance direction 15 by the pair of discharge rollers 44, and is discharged onto the discharge tray 21. In the embodiment, driving force is transmitted from the conveyance motor 101 to the conveyance roller 60, and driving force is transmitted from the conveyance roller 60 to the discharge roller 62.

The means for conveying paper 12 is not limited to the pairs of rollers described above. For example, a conveyance belt may be disposed instead of the pair of conveyance rollers 59 and the pair of discharge rollers 44.

[Rotary Encoder]

A rotary encoder (not shown) for detecting the amount of rotation of the conveyance motor 101 is provided at the conveyance motor 101. The rotary encoder includes an encoder disk (not shown) and an optical sensor 75 (see FIG. 4). The encoder disk is provided at the shaft of the conveyance motor 101 and is configured to rotate together with the conveyance motor 101. The encoder disk is formed with a pattern that a light transmission portion allowing light to transmit therethrough and a non-transmission portion not allowing light to transmit therethrough are arranged alternately at an equal pitch in the circumferential direction. When the encoder disk rotates, a pulse signal is generated each time the light transmission portion and the non-transmission portion are detected by the optical sensor 75. The generated pulse signal is outputted to the controller 130 (see FIG. 4). The controller 130 calculates the amount of rotation of the conveyance motor 101 based on the pulse signal. Alternatively, the rotary encoder may be provided at the conveyance roller 60, for example, not at the conveyance motor 101.

[Power Supply 160]

As shown in FIG. 4, the MFP 10 includes the power supply 160. The power supply 160 includes a known electronic circuit including a regulator circuit that boosts a power supply voltage supplied from an external power supply through a power supply plug to a desired voltage value, a capacitor that keeps the voltage boosted by the regulator circuit, and so on. Wiring of the electronic circuit is formed in each layer of a print circuit board, and electronic parts such as a capacitor is mounted on the print circuit board.

[Controller 130 and Memory 140]

The configuration of the controller 130 and the memory 140 will be described below while referring to FIG. 4. The controller 130 performs processing in accordance with a flowchart described later, thereby realizing the technique of this disclosure. The controller 130 controls overall operations of the MFP 10. The controller 130 includes a CPU 131 and an ASIC 135. The memory 140 includes a ROM 132, a RAM 133, and an EEPROM 134. The CPU 131, the ASIC 135, the ROM 132, the RAM 133, and the EEPROM 134 are connected by an internal bus 137 with one another.

The ROM 132 stores programs for the CPU 131 to control various operations, and so on. The RAM 133 is used as a storage area for temporarily storing data, signals, and so on that are used when the CPU 131 executes the programs, or as a work area of data processing. The EEPROM 134 stores setting, flags, and so on that should be kept after power off.

The ASIC 135 includes a first driving circuit 121 and a second driving circuit 122.

The first driving circuit 121 is a current control circuit that controls a current that flows from the power supply 160 to the conveyance motor 101. The CPU 131 sends a drive signal for rotating the conveyance motor 101 to the first driving circuit 121. The first driving circuit 121 controls the power supply 160 such that a first driving current corresponding to the drive signal acquired from the CPU 131 is supplied from the power supply 160 to the conveyance motor 101. Here, the drive signal is variable, and thus the first driving current is also variable.

The conveyance motor 101 is rotated in accordance with the supplied first driving current. Specifically, the controller 130 causes the variable first driving current to flow from the power supply 160 so as to drive the conveyance motor 101. The rotation velocity of the conveyance motor 101 increases, as the supplied first driving current increases. As the rotation velocity of the conveyance motor 101 increases, the conveyance roller 60 is rotated at higher velocity, and thus the conveyance velocity of the paper 12 increases.

The second driving circuit 122 is a voltage control circuit that controls a voltage that is applied from the power supply 160 to the carriage motor 103. The CPU 131 sends the drive signal for rotating the carriage motor 103 to the second driving circuit 122. The second driving circuit 122 controls the power supply 160 such that a drive voltage corresponding to the drive signal acquired from the CPU 131 is applied from the power supply 160 to the carriage motor 103. Here, the drive signal is variable, and thus the drive voltage is also variable.

The carriage motor 103 is rotated in accordance with the applied drive voltage. Here, when the drive voltage is applied from the power supply 160 to the carriage motor 103, a current (hereinafter referred to as second driving current) flows from the power supply 160 to the carriage motor 103. The magnitude of the second driving current differs depending on the drive voltage. In other words, the controller 130 causes the variable second driving current to flow from the power supply 160 so as to drive the carriage motor 103. The rotation velocity of the carriage motor 103 increases as the applied drive voltage increases. As the rotation velocity of the carriage motor 103 increases, the carriage 40 is moved at higher velocity.

The second driving circuit 122 includes a current limiting circuit 123. The current limiting circuit 123 is a protection circuit that cuts a part of the second driving current flowing from the power supply 160 to the carriage motor 103, the part exceeding a limiting current. The limiting current limits a maximum current that flows through the carriage motor 103. As the current limiting circuit 123, a current limiting circuit configured to adjust the value of the limiting current described above is used. That is, the current limiting circuit 123 is a current limiting circuit in which the value of the limiting current is variable. For example, the adjustment of the value of the limiting current is performed by changing an input value to the limiting current pin of an IC chip of the second driving circuit 122 including the current limiting circuit 123.

The controller 130 sets the limiting current described above to a current obtained by subtracting the first driving current from the allowable current of the power supply 160 (that is, the allowable current of the power supply 160=the first driving current+the limiting current). The allowable current of the power supply 160 is a fixed value that is specified by the performance of the power supply that is used. The first driving current is a variable value as described above. Hence, the limiting current is a variable value. For example, a signal corresponding to a current value calculated by the subtraction described above is inputted to the limiting current pin of the IC chip described above, and thus the limiting current is changed in accordance with a change in the signal.

Figure 5:
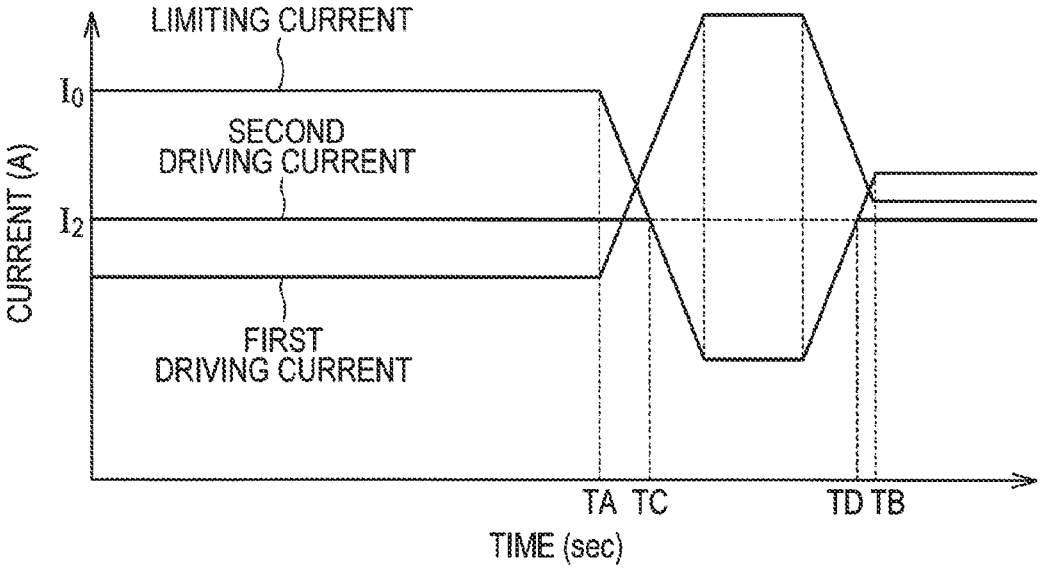
FIG. 5 is a diagram showing an example of characteristics of a first driving current, a second driving current, and a limiting current with respect to time.

As shown in FIG. 5, for example, when the value of the first driving current increases in a section between time TA and TB in a case where a value I2 of the second driving current is a constant value that is smaller than a value I0 of the limiting current, the limiting current decreases relatively according to that increase. Consequently, in a section between time TC and TD, the value I2 of the second driving current becomes larger than the limiting current. However, a part exceeding the limiting current is cut by the current limiting circuit 123. Consequently, the value of the second driving current is smaller than the value I2 in the section between time TC and TD. This partially-cut second driving current is referred to as "limited second driving current". In other words, the smaller one of the second driving current and the limiting current is supplied to the carriage motor 3.

Known circuits may be adopted as the first driving circuit 121 (current control circuit), the second driving circuit 122 (voltage control circuit), and the current limiting circuit 123 described above.

The optical sensor 75 of the rotary encoder is connected to the ASIC 135. The controller 130 calculates, based on an electrical signal received from the optical sensor 75, the amount of rotation of the conveyance motor 101.

The optical sensor 156 of the linear encoder 157 is connected to the ASIC 135. The controller 130 recognizes the position of the carriage 40 based on an electrical signal received from the optical sensor 156. The controller 130 detects the moving velocity of the carriage 40 based on a time that is counted with a timer incorporated in the controller 130 and that elapses after the start of the movement of the carriage 40 and on the movement distance of the carriage 40 after the start of the movement (the position of the carriage 40) that is calculated from the recognized position of the carriage 40. In other words, the controller 130 and the linear encoder 157 function as a velocity sensor.

The piezoelectric elements 45 are connected to the ASIC 135. The piezoelectric elements 45 are operated by supply of power by the controller 130 through an unillustrated driving circuit. The controller 130 controls the supply of power to the piezoelectric elements 45 such that ink droplets are selectively ejected from a plurality of nozzles 39.

When image recording is performed on the paper 12, the controller 130 controls the conveyance motor 101 so as to cause the pair of conveyance rollers 59 and the pair of discharge rollers 44 to perform intermittent conveyance processing in which the conveyance (line feed processing) of the paper 12 by a particular conveyance amount and the stop thereof are alternately repeated. The amount of conveyance of the paper 12 is, for example, recognized by counting the amount of rotation of the conveyance roller 60 with the rotary encoder described above.

The controller 130 performs image recording processing while the paper 12 is stopped in the intermittent conveyance processing. The image recording processing is processing in which while the carriage 40 is being moved along the left-right direction X, the supply of power to the piezoelectric elements 45 is controlled, and in which thus ink droplets are ejected from the nozzles 39. The controller 130 performs, in the image recording processing, one image recording pass in which while the carriage 40 is being moved rightward or leftward, ink droplets are ejected from the nozzles 39. In this way, the image recording for one pass is performed on the paper 12.

The intermittent conveyance processing and the image recording for one pass are alternately repeated, and thus the image recording is performed on all recordable regions of the paper 12. In other words, the controller 130 performs a plurality of passes so as to perform the image recording on one paper 12.

Regarding the controller 130, only the CPU 131 may perform various processing, only the ASIC 135 may perform various processing, or the CPU 131 and the ASIC 135 may perform various processing in cooperation with each other. Further, regarding the controller 130, a single CPU 131 may perform processing independently, or a plurality of CPUs 131 may perform processing in a distributed manner. Further, regarding the controller 130, a single ASIC 135 may perform processing independently, or a plurality of ASICs 135 may perform processing in a distributed manner.

Figure 6:
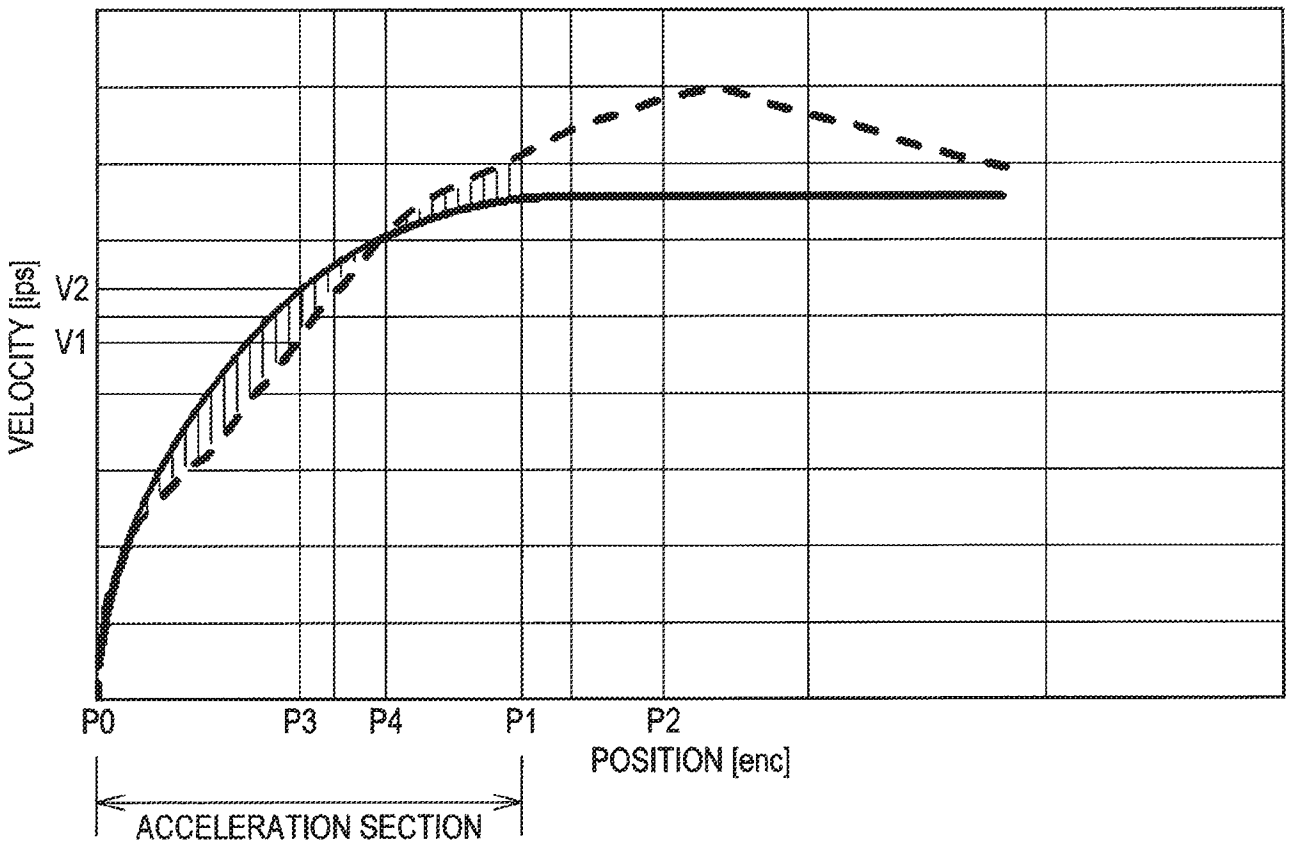
FIG. 6 is a diagram showing characteristics of moving velocity of the carriage 40 with respect to its position.

As indicated by a solid curve in FIG. 6, the ROM 132 stores, as a data table, ideal characteristics of the moving velocity of the carriage 40 with respect to the movement distance (the position of the carriage 40) by which the carriage 40 has moved after the start of the movement. The ideal characteristics may be stored in the EEPROM 134.

[Image Recording Control by Controller 130]

Figure 7:
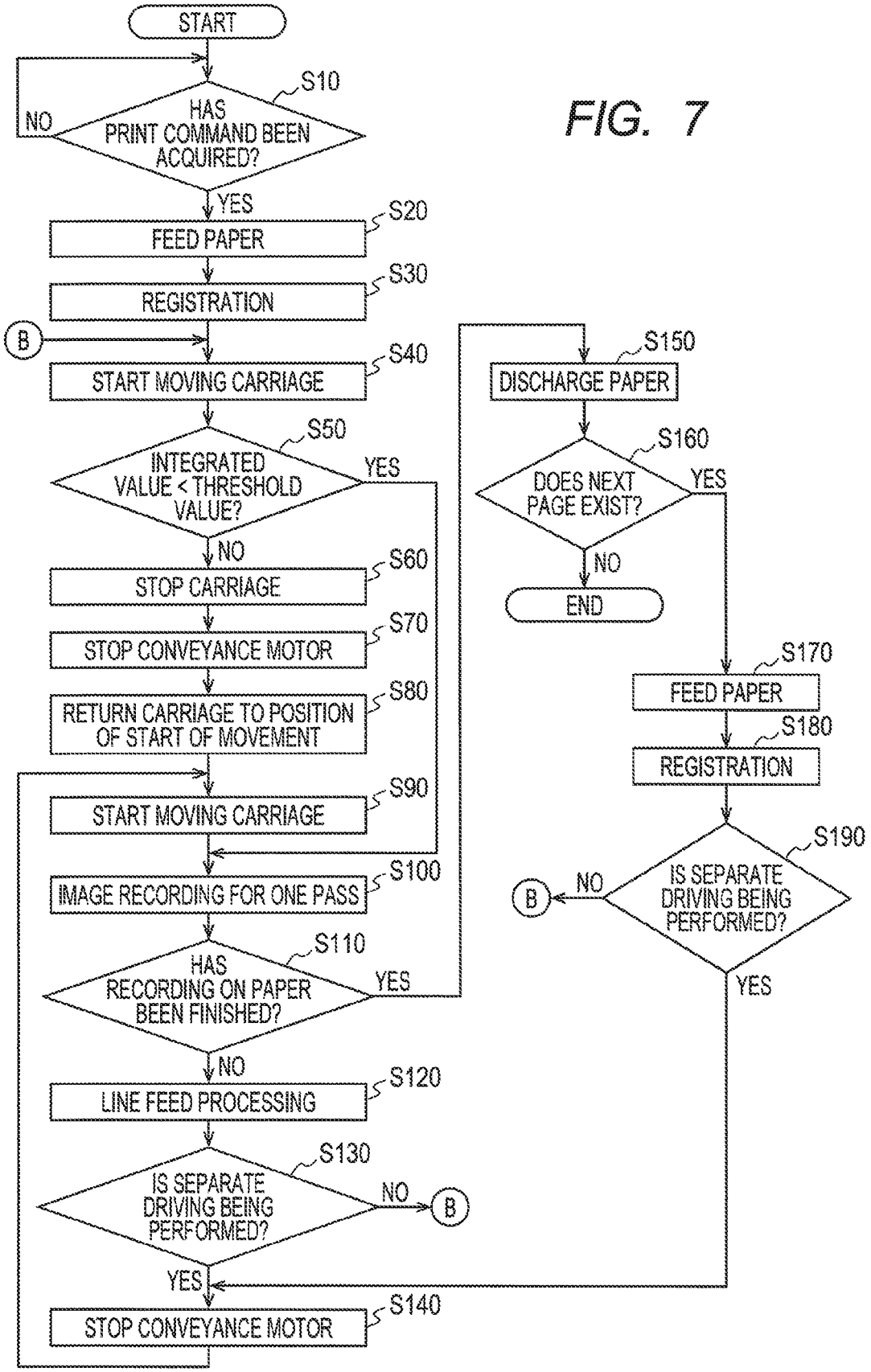
FIG. 7 is a flowchart for illustrating processing of image recording control.

In the printer unit 11 configured as described above, a series of image recording control are performed in which the paper 12 is fed and the image recording is performed on the fed paper 12 by the controller 130. The processing of the image recording control will be described below with reference to the flowchart of FIG. 7.

A print command is sent to the controller 130 from the operation interface 17 (see FIG. 1) of the MFP 10, an external apparatus connected to the MFP 10 and so on. The print command includes a command indicating the start of the image recording control as well as information on the size of the paper 12 and image data recorded as an image on the paper 12.

Upon acquiring the print command (S10), the controller 130 drives a feed motor. In this way, the feed roller 25 feeds the paper 12 supported on the feed tray 20 to the conveyance path 65 (S20).

Then, the controller 130 performs registration of the paper 12 (S30). In the registration, the controller 130 uses the first driving circuit 121 so as to control the power supply 160, and thereby supplies the first driving current from the power supply 160 to the conveyance motor 101. In this way, the conveyance motor 101 is driven, and the pair of conveyance rollers 59 receiving driving force from the conveyance motor 101 conveys the paper 12 in the conveyance direction 15. The controller 130 stops the supply of the first driving current so as to stop the pair of conveyance rollers 59, and thereby stops the paper 12 in an image recording start position. The image recording start position is a position at which the downstream end of an image recording region in the paper 12 in the conveyance direction 15 faces one of the plurality of nozzles 39 that is arranged most downstream in the conveyance direction 15.

The controller 130 uses the second driving circuit 122 so as to control the power supply 160, and thereby applies the drive voltage from the power supply 160 to the carriage motor 103. In this way, the second driving current is supplied from the power supply 160 to the carriage motor 103. In this way, the carriage motor 103 is driven, and thus the carriage 40 receiving driving force from the carriage motor 103 is started to move in the left-right direction X (S40).

In the embodiment, before the paper 12 is stopped in the image recording start position in S30, the movement of the carriage 40 is started. In other words, parts of S30 and S40 are performed in parallel. Hence, the power supply 160 supplies the second driving current to the carriage motor 103 while supplying the first driving current to the conveyance motor 101.

Here, the part of the second driving current that exceeds the limiting current is cut by the current limiting circuit 123. The magnitude of the limiting current is obtained by subtracting the first driving current from the allowable current of the power supply 160. Hence, the total of the first driving current and the second driving current is prevented from exceeding the allowable current, and thus a failure does not occur in the operation of the power supply 160. However, when the part of the second driving current that exceeds the limiting current is unexpectedly cut, the moving velocity of the carriage 40 supplied with the cut second driving current may become lower than the assumed velocity (the velocity in the ideal characteristics described previously).

Hence, when the movement of the carriage 40 is started, the controller 130 determines whether to perform separate driving (division driving) described later, based on the moving velocity of the carriage 40.

Specifically, the controller 130 compares the actual characteristics with the ideal characteristics stored in the ROM 132, the actual characteristics being the moving velocity of the carriage 40 with respect to the movement distance by which the carriage 40 has moved after the start of movement (the position of the carriage 40). An example of the actual characteristics is indicated by a broken curve in FIG. 6. For example, in the actual characteristics, the movement distance and the moving velocity detected with the controller 130 and the linear encoder are stored as a data table in the RAM 133 each time the detection is performed. In the embodiment, the controller 130 determines whether the integrated value of the amount of deviation (difference) of the actual characteristics when the carriage 40 accelerates after the start of the movement from the ideal characteristics is greater than a preset threshold value (S50). More specifically, the integrated value of the amount of deviation is the integrated value of the absolute value of the deviation.

In a case where the actual characteristics and the ideal characteristics are as shown in FIG. 6, the integrated value of the amount of deviation is the area of the hatched portion in the acceleration section in FIG. 6. The threshold value is set to a boundary of whether a so-called overshoot is significant where the velocity of the carriage 40 is larger than the velocity in the ideal characteristics after the carriage 40 shifts from an acceleration state to a constant-velocity state. For example, the threshold value is determined by repeating experiments of moving the carriage 40. The threshold value is stored in the ROM 132 or the EEPROM 134.

The controller 130 makes the determination in S50 at timing after the carriage is started to move based on the print command (S40) and before the recording head 38 ejects ink droplets (S100). As shown in FIG. 6, in the embodiment, the controller 130 calculates the integrated value in a section between a position P0 and a position P1 (the entire acceleration section of the carriage 40). Here, the position P1 is a position through which the carriage 40 passes before the carriage 40 reaches a position P2 (the constant velocity section of the carriage 40) at which the recording head 38 starts to eject ink droplets.

A section in which the controller 130 calculates the integrated value is not limited to the section between the position P0 and the position P1. For example, in a case where the position at which the recording head 38 starts to eject ink droplets is a position P4 (that is closer to the position P0 than the positions P1 and P2 are and that is in the acceleration section of the carriage 40), as shown in FIG. 6, the controller 130 may calculate the integrated value described above in a section between the position P0 and a position P3 (a part of the acceleration section of the carriage 40) that is a section closer to the position P0 than the position P4 is.

When the integrated value of the amount of deviation is not smaller than the threshold value, that is, when the integrated value of the amount of deviation is larger than or equal to the threshold value (S50: No), the controller 130 performs the separate driving. The separate driving is processing in which the conveyance motor 101 and the carriage motor 103 are not simultaneously driven and in which the conveyance motor 101 and the carriage motor 103 are individually driven (for example, the conveyance motor 101 is driven and thereafter the carriage motor 103 is driven).

As the separate driving, S60 to S90 that will be described below are performed. Before ink droplets are ejected from the nozzles 39, the controller 130 first stops the application of the drive voltage (the supply of the second driving current) so as to stop the carriage motor 103, and thereby stops the carriage 40 (S60). Thereafter, when the paper 12 reaches the image recording start position, the controller 130 stops the supply of the first driving current so as to stop the conveyance motor 101 (S70).

After the stop of the conveyance motor 101, the controller 130 drives the carriage motor 103 again so as to move the carriage 40 to the original position (the position at the time of start of the movement in S40) (S80).

Thereafter, the controller 130 starts, as in S40, the movement of the carriage 40 (S90). Here, when S90 is executed, the conveyance motor 101 is already stopped. Specifically, in S90, the controller 130 applies the drive voltage to the carriage motor 103 without supplying the first driving current to the conveyance motor 101 (in other words, supplies the second driving current to the carriage motor 103).

Then, the controller 130 controls the piezoelectric elements 45 while moving the carriage 40 continuously from S80 so as to eject ink droplets from the nozzles 39 toward the paper 12, and thereby performs the image recording for one pass on the paper 12 (S100).

In S50, when the integrated value of the amount of deviation is smaller than the threshold value (S50: Yes), the controller 130 performs the image recording for one pass on the paper 12 without performing the separate driving described above (the operation of S60 to S90) (S100).

After the image recording for one pass on the paper 12, the controller 130 determines, based on image data and information on the size of the paper 12 included in the print command, whether the image recording on the current paper 12 has been finished (S110).

When the image recording on the current paper 12 is not finished (S110: No), the line feed processing is performed (S120). In the line feed processing, the controller 130 drives, as in S30, the conveyance motor 101 so as to cause the pair of conveyance rollers 59 and the pair of discharge rollers 44 to convey the paper 12 by a particular amount of conveyance.

When the separate driving is performed (when S60 to S90 are performed), the driving of the conveyance motor 101 in S120 is performed after the stop of the carriage 40. On the other hand, when the separate driving is not performed (when S60 to S90 are not performed), the driving of the conveyance motor 101 in S120 may be performed before the stop of the carriage 40 (for example, during the deceleration of the carriage 40).

When the separate driving is being performed (S130: Yes), the movement of the carriage 40 is started after the conveyance motor 101 driven in S120 is stopped (S140) (S90). Thereafter, until the image recording on the paper 12 is finished (S110: Yes), the image recording for one pass and the conveyance of the paper 12 by the particular amount of conveyance are repeatedly performed (S90 to S120).

When the separate driving is not being performed (S130: No), the movement of the carriage 40 is started before the conveyance motor 101 driven in S120 is stopped (S40). In this case, the determination in S50 is performed again, and the separate driving is performed depending on the result of the determination. Thereafter, until the image recording on the paper 12 is finished (S110: Yes), the image recording for one pass and the conveyance of the paper 12 by the particular amount of conveyance are repeatedly performed (S40 to S120).

In response to determining that the image recording on the paper 12 is finished in S110 (S110: Yes), the controller 130 controls the pair of conveyance rollers 59 and the pair of discharge rollers 44 to convey the paper 12 in the conveyance direction 15 so as to discharge the paper 12 to the discharge tray 21 (S150).

Then, the controller 130 determines whether image data that has not yet been recorded on the paper 12 is present in the image data included in the print command, that is, whether image recording on the next page is present (S160).

When the image recording on the next page is not present (S160: No), the controller 130 finishes a series of image recording control.

When the image recording on the next page is present (S160: Yes), the controller 130 feeds the subsequent paper 12 from the feed tray 20 to the conveyance path 65 (S170), and performs the registration (S180). The feeding of the subsequent paper 12 (S170) may be performed simultaneously with the discharge of the preceding paper 12 (S150).

Then, the controller 130 determines, as in step S130, whether the separate driving is being performed (S190). When the separate driving is being performed (S190: Yes), without performing S40 to S80, the movement of the carriage 40 is started (S90) after the stop of the conveyance motor 101 (S140), and the image recording is performed on the subsequent paper 12 (S90 to S120). When the separate driving is not being performed (S190: No), S40 and the subsequent steps are performed, and thus the image recording is performed on the subsequent paper 12 (S40 to S120).

In the embodiment, once the separate driving is performed, the separate driving is continued until at least all the image data included in the print command is recorded on the paper 12, that is, until a print job corresponding to the print command is completed. In other words, in the processing of the flowchart shown in FIG. 7, once the separate driving is performed (S50: No), the processing is not returned from the separate driving to the original processing (the processing in which the conveyance motor 101 and the carriage motor 103 are driven simultaneously) during the processing of the flowchart.

The timing at which the separate driving is stopped and is returned to the original processing is set to timing such as the timing at which the print job is completed, the timing at which the image recording on one page of the paper 12 is finished or the timing at which a particular time (for example, one day) elapses.

In the embodiment, the limiting current is variably set based on the variable first driving current such that the total of the limiting current and the first driving current does not exceed the allowable current. In this way, it is not necessary to set the limiting current to an unnecessarily low value. Consequently, the current that flows through the carriage motor 103 can be increased until the current that flows through the power supply 160 is close to the allowable current. Thus, the conveyance motor 101 (an example of the drive target) and the carriage motor 103 can be driven by efficiently using the performance (capacity) of the power supply 160.

As the first driving current increases, the limiting current decreases. This increases the possibility that the second driving current is cut and limited. Then, the carriage motor 103 is driven with a current that is smaller than or equal to the limiting current, and thus the moving velocity of the carriage 40 becomes lower than a normal velocity, and hence the quality of the image recorded on the paper 12 may be affected. In the embodiment, in such a case, the separate driving is performed. In this case, the conveyance motor 101 is not driven while the carriage motor 103 is being driven, and thus the lowering of the limiting current is suppressed. Hence, the current that flows through the carriage motor 103 is maintained to be large, and thus the lowering of the moving velocity of the carriage 40 is suppressed. In this way, the influence on the quality of the image recorded on the paper 12 is reduced.

If modes of whether to perform the separate driving are switched many times during a print job, the time that is needed for completing the print job may be increased. In the embodiment, the modes of whether to perform the separate driving are not switched many times during a print job, and thus an increase in the time needed for completing the print job is suppressed.

According to the embodiment, the separate driving is performed before ejection of ink droplets. This reduces an influence on the quality of the image as a result of the ejection of ink droplets from the recording head 38 in a state where the moving velocity of the carriage 40 is lower than the normal velocity while the separate driving is not being performed.

As the integrated value of the amount of deviation of the actual characteristics from the ideal characteristics increases, a so-called overshoot becomes significant in which after a shift from the acceleration to the constant velocity of the carriage 40, the velocity of the carriage 40 exceeds the velocity in the ideal characteristics. This increases an influence on the quality of the image recorded on the paper 12. In the embodiment, when the integrated value of the amount of deviation is large, the separate driving is performed, and thus the influence on the quality of the image described above is reduced.

According to the embodiment, when the separate driving is not performed, the rotation of the conveyance roller 60 and the movement of the carriage 40 are simultaneously performed at the time of the image recording on the paper 12, and thus image recording can be performed at high speed.

According to the embodiment, since the first driving circuit 121 is a current control circuit, it is easy to estimate the first driving current. Hence, the accuracy of the limiting current that is obtained by subtracting the first driving current from the allowable current is enhanced.

According to the embodiment, since the second driving circuit 122 is a voltage control circuit, it is difficult to estimate the second driving current. However, the part of the second driving current that exceeds the limiting current is cut by the current limiting circuit 123. Thus, even if it is difficult to estimate the second driving current, the current passing through the power supply 160 can be prevented from exceeding the allowable current.

[Modification]

While the disclosure has been described in detail with reference to the above aspects thereof, it would be apparent to those skilled in the art that various changes and modifications may be made therein without departing from the scope of the claims.

In the embodiment described above, in S50, the controller 130 determines whether the integrated value of the amount of deviation of the actual characteristics when the carriage 40 accelerates after the start of the movement from the ideal characteristics is greater than the preset threshold value (S50). However, the determination described above may be made based on a value other than the integrated value of the amount of deviation.

For example, in S50, the controller 130 may determine whether the separate driving is performed based on the amount of deviation of the moving velocity V1 of the carriage 40 at a particular position (for example, the position P3 in FIG. 6) in the range (in the section between the position P0 and the position P1 in FIG. 6) in which the carriage 40 accelerates after the start of the movement in the actual characteristics relative to the moving velocity V2 of the carriage 40 at the particular position in the ideal characteristics. Specifically, when the difference between the moving velocity V1 and the moving velocity V2 is larger than or equal to the preset threshold value, the controller 130 performs the separate driving (S60 to S90), and then performs the recording processing on the paper 12 (S100). When the difference is smaller than the threshold value, the controller 130 performs recording processing on the paper 12 without performing the separate driving (S100).

As in the embodiment, the threshold value is a value that is set to the boundary of whether a so-called overshoot is significant where the velocity of the carriage 40 is larger than the velocity in the ideal characteristics. The threshold value is determined by repeating experiments of moving the carriage 40. Note that the threshold value in the embodiment corresponds to an integrated value whereas the threshold value in this modification corresponds to a difference of the moving velocity, and thus the both threshold values are different from each other.

Figure 8:
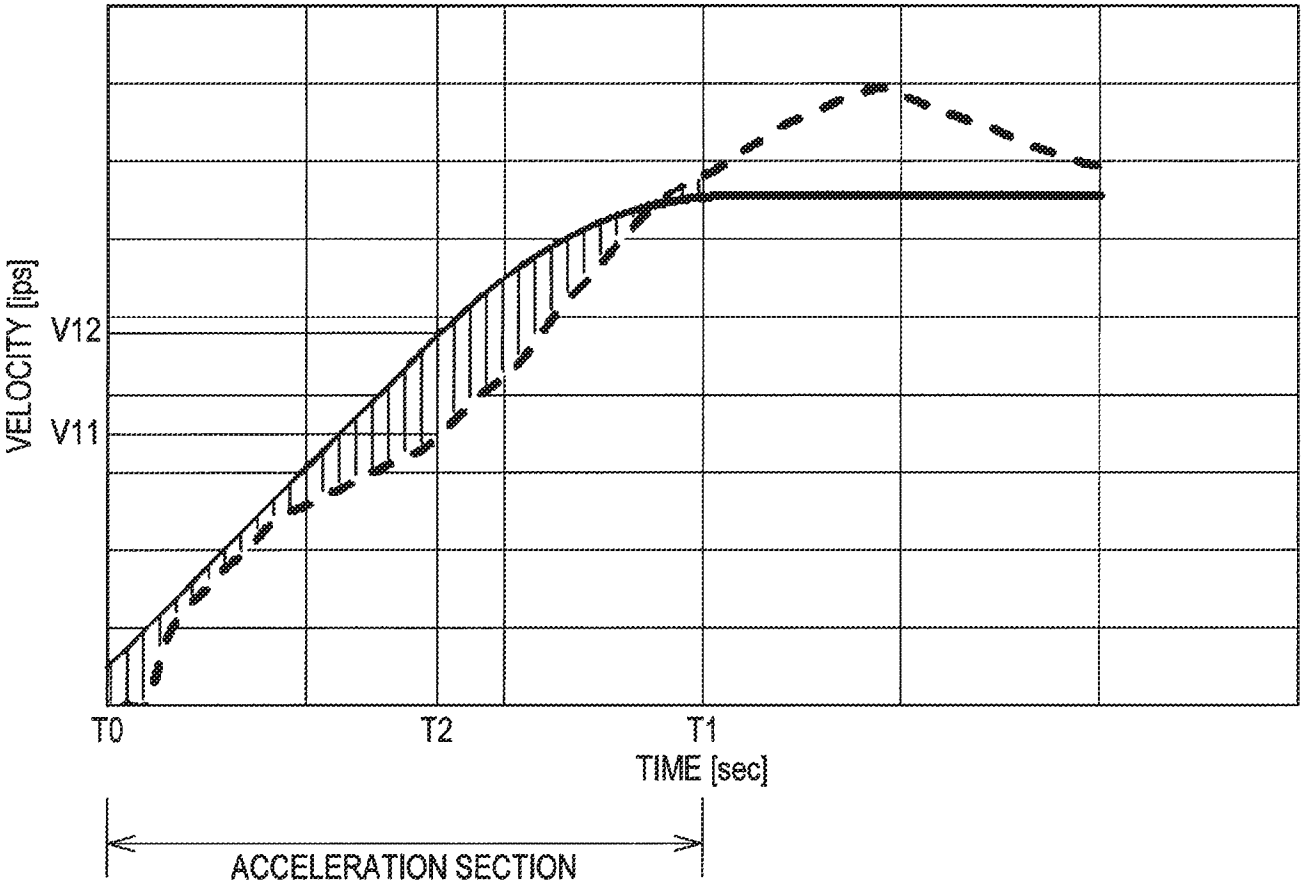
FIG. 8 is a diagram showing characteristics of moving velocity of the carriage 40 with respect to time from start of movement.

In the embodiment described above, the ideal characteristics stored in the ROM 132 and the actual characteristics stored in the RAM 133 are formed with the movement distance (the position of the carriage 40) after the start of the movement of the carriage 40 and the moving velocity of the carriage 40 with respect to the movement distance. However, the ideal characteristics and the actual characteristics are not limited to these. As shown in FIG. 8, for example, the ideal characteristics and the actual characteristics may be formed with the time after the start of the movement of the carriage 40 and the moving velocity of the carriage 40 with respect to the time.

In this case, as will be described in detail below, the processing in S50 partially differs from the processing in the embodiment described above. The controller 130 compares the actual characteristics formed with the time and the moving velocity with the ideal characteristics formed with the time and the moving velocity. An example of the actual characteristics is indicated by a broken curve in FIG. 8. An example of the ideal characteristics is indicated by a solid curve in FIG. 8. In FIG. 8, the controller 130 determines whether the integrated value (the hatched area in FIG. 8) of the amount of deviation of the actual characteristics in the acceleration section (that is the time section of acceleration between time T0 and T1) from the ideal characteristics is greater than a preset threshold value.

As in the embodiment, the threshold value is a value that is set to the boundary of whether a so-called overshoot is significant where the velocity of the carriage 40 is larger than the velocity in the ideal characteristics. The threshold value is determined by repeating experiments of moving the carriage 40.

In this modification, as in the case of the embodiment described above, the determination in S50 is made at timing after the carriage is started to move (S40) and before the recording head 38 ejects ink droplets (S100). In this modification, as in the case of the embodiment described above, the integrated value of the amount of deviation may be calculated for the entire acceleration section or may be calculated for a part of the acceleration section.

In a case where the ideal characteristics and the actual characteristics are formed with the time after the start of the movement of the carriage 40 and the moving velocity of the carriage 40 with respect to the time, the determination in S50 may be made based on a value other than the integrated value of the amount of deviation described above.

For example, in S50, the controller 130 may determine whether to perform the separate driving based on the amount of deviation of a moving velocity V11 of the carriage 40 at a particular time (for example, time T2 in FIG. 8) in the actual characteristics from a moving velocity V12 of the carriage 40 at the particular position in the ideal characteristics, the particular time being in a time period in which the carriage 40 accelerates from the start of movement (time T0 to T1 in FIG. 8). Specifically, in a case where the difference between the moving velocity V11 and the moving velocity V12 is larger than or equal to a threshold value that is preliminarily set, the controller 130 performs the separate driving (S60 to S90), and then performs recording processing on paper 12 (S100). In a case where the difference between the moving velocity V11 and the moving velocity V12 is smaller than the threshold value, the controller 130 performs recording processing on paper 12 (S100) without performing the separate driving.

As in the above-described modification, the threshold value is a value that is set to the boundary of whether a so-called overshoot is significant where the velocity of the carriage 40 is larger than the velocity in the ideal characteristics. The threshold value is determined by repeating experiments of moving the carriage 40. Note that the threshold value in the above-described modification corresponds to an integrated value whereas the threshold value in this modification corresponds to a difference of the moving velocities, and thus the both threshold values are different from each other.

Figure 9:
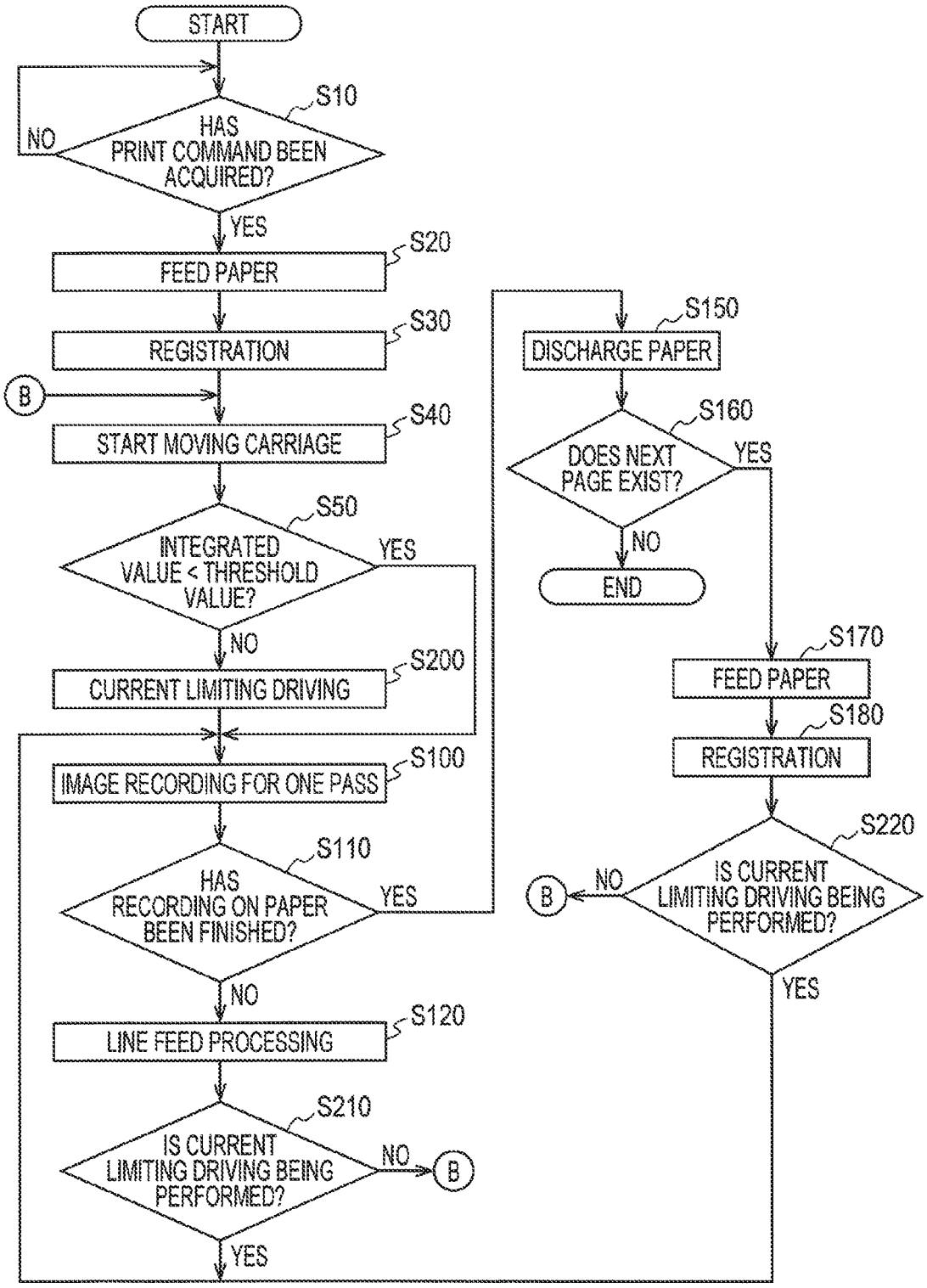
FIG. 9 is a flowchart for illustrating processing of image recording control according to a modification.

In the embodiment described above, the controller 130 performs the separate driving (S60 to S90) according to the result of the determination (the amount of deviation of the velocity of the actual characteristics or the integrated value of the amount of deviation) based on the moving velocity of the carriage 40 (S50: No). As shown in FIG. 9, however, the controller 130 may perform current limiting driving (S200) instead of the separate driving.

The current limiting driving is driving in which the maximum current that flows through the conveyance motor 101 is reduced while continuing the simultaneous driving of the conveyance motor 101 and the carriage motor 103.

As indicated by broken lines in FIG. 4, in this modification, the first driving circuit 121 includes a current limiting circuit 124.

The current limiting circuit 124 has the same function as the current limiting circuit 123. In other words, the current limiting circuit 124 is a protection circuit that cuts a part of the first driving current flowing from the power supply 160 to the conveyance motor 101 that exceeds the limiting current. The limiting current limits a maximum current that flows through the conveyance motor 101. The current limiting circuit 124 may be a current limiting circuit in which the value of the limiting current is a fixed value, or may be a current limiting circuit in which, as in the current limiting circuit 123, the value of the limiting current can be adjusted.

When the current limiting driving is not performed, the controller 130 controls the current limiting circuit 124 not to function. When the current limiting driving is performed, the controller 130 controls the current limiting circuit 124 to function. The switching of whether the current limiting circuit 124 functions is performed, for example, by changing an input value to the function switching pin of the current limiting circuit 124 of an IC chip constituting the first driving circuit 121. As the current limiting circuit 124, a known circuit may be adopted.

As in the separate driving, once the current limiting driving is performed, the current limiting driving is continued until at least a print job corresponding to a print command is completed. In the flowchart shown in FIG. 9, when the current limiting driving is being performed in S210 and S220 (S210: Yes, S220: Yes), the image recording for one pass is performed on the paper 12 without performing S200 (S100). That is, once the current limiting driving is performed (S200), the processing is not returned from the current limiting driving to the original processing (processing in a state where the current limiting circuit 124 does not function) during the processing of the flowchart. The timing when the current limiting driving is stopped and is returned to the original processing may be set to, for example, the timing when a print job is finished, the timing when image recording for paper 12 of one page is finished, the timing when a particular time (for example, one day) has elapsed, and so on.

When the carriage motor 103 is driven with a current that is smaller than or equal to the limiting current, and the moving velocity of the carriage 40 becomes lower than the normal velocity, the quality of the image recorded on the paper 12 may be affected. In the modification described above, in such a case, the current that flows through the conveyance motor 101 is limited. In this way, because the current that flows through the carriage motor 103 is relatively increased, the moving velocity of the carriage 40 becomes close to the normal velocity. With this configuration, an influence on the image quality of recording on paper 12 can be reduced.

If modes of whether to perform the current limiting driving are switched many times during a print job, there is a possibility that a time required for completing the print job increases. In the above-described modification, the modes of whether to perform the current limiting driving are not switched during a print job, and thus an increase in time required for completing a print job can be suppressed.

In the embodiment, the conveyance motor 101 is an example of a drive target, and the first driving circuit 121 is a current control circuit that controls the current that flows from the power supply 160 to the conveyance motor 101. However, as long as the drive target may be driven simultaneously with the carriage motor 103, the drive target is not limited to the conveyance motor 101, and may be, for example, a feed motor or a motor that moves an image sensor of a scanner provided in the MFP 10. The drive target may be other than a motor, and may be the piezoelectric elements 45, for example. In other words, the first driving circuit 121 may be a circuit for supplying power from the power supply 160 to the piezoelectric elements 45.

In the embodiment, the first driving circuit 121 is a current control circuit, and the second driving circuit 122 is a voltage control circuit, but there is no limitation to this configuration. For example, the first driving circuit 121 may be the voltage control circuit and the second driving circuit 122 may be a current control circuit, or both the first driving circuit 121 and the second driving circuit 122 may be voltage control circuits, or both the first driving circuit 121 and the second driving circuit 122 may be current control circuits.

In the embodiment, the MFP 10 is an inkjet printer having a function of recording an image on paper 12 with an inkjet method. However, the MFP 10 is not limited to an inkjet printer as long as the MFP 10 includes a recording head that records an image on paper 12 and a carriage on which the recording head is mounted. For example, the MFP 10 may be a so-called thermal printer such as a thermal printer that uses heat-sensitive paper and a thermal-transfer printer that uses an ink ribbon.

What is claimed is:

1. An image recording apparatus comprising:

a power supply;

a drive target;

a carriage motor;

a carriage configured to move by receiving driving force from the carriage motor;

a recording head mounted on the carriage; and a controller configured to:

control the power supply to supply a first driving current to the drive target, the first driving current being variable;

when a second driving current for driving the carriage motor does not exceed a limiting current, control the power supply to supply the second driving current to the carriage motor, the second driving current being variable, the limiting current being a variable current obtained by subtracting the first driving current from an allowable current of the power supply; and when the second driving current exceeds the limiting current, control the power supply to supply a limited second driving current to the carriage motor, the limited second driving current being obtained by cutting a part of the second driving current, the part exceeding the limiting current.

2. The image recording apparatus according to claim 1, further comprising a velocity sensor configured to detect a moving velocity of the carriage, wherein the controller is configured to determine, based on the moving velocity detected by the velocity sensor, whether to perform separate driving in which the drive target and the carriage motor are not driven simultaneously.

3. The image recording apparatus according to claim 2, wherein the controller is configured to continue the separate driving until a print job corresponding to a print command is completed.

4. The image recording apparatus according to claim 1, further comprising a velocity sensor configured to detect a moving velocity of the carriage, wherein the controller is configured to determine, based on the moving velocity detected by the velocity sensor, whether to perform current limiting driving in which a maximum current that flows through the drive target is reduced.

5. The image recording apparatus according to claim 4, wherein the controller is configured to continue the current limiting driving until a print job corresponding to a print command is completed.

6. The image recording apparatus according to claim 2, wherein the recording head is configured to eject ink droplets; and wherein the controller is configured to determine whether to perform the separate driving at a timing after the carriage starts moving based on a print command from the controller and before the recording head ejects ink droplets.

7. The image recording apparatus according to claim 2, further comprising a memory configured to store ideal characteristics of the moving velocity of the carriage with respect to time from start of movement of the carriage, wherein the controller is configured to determine whether to perform the separate driving, based on a difference between a first moving velocity and a second moving velocity, the first moving velocity being the moving velocity of the carriage detected by the velocity sensor at a particular time in a time period in which the carriage accelerates from start of movement, the second moving velocity being the moving velocity of the carriage at the particular time in the ideal characteristics.

8. The image recording apparatus according to claim 2, further comprising a memory configured to store ideal characteristics of the moving velocity of the carriage with respect to a position from start of movement of the carriage, wherein the controller is configured to determine whether to perform the separate driving, based on a difference between a first moving velocity and a second moving velocity, the first moving velocity being the moving velocity of the carriage detected by the velocity sensor at a particular position in a positional range in which the carriage accelerates from start of movement, the second moving velocity being the moving velocity of the carriage at the particular position in the ideal characteristics.

9. The image recording apparatus according to claim 2, further comprising a memory configured to store ideal characteristics of the moving velocity of the carriage with respect to time from start of movement of the carriage, wherein the controller is configured to determine whether to perform the separate driving, based on an integrated value of a difference between the moving velocity in a particular period in actual characteristics and the moving velocity in the particular period in the ideal characteristics, the particular period being an entirety or a part of a period in which the carriage accelerates from start of movement.

10. The image recording apparatus according to claim 2, further comprising a memory configured to store ideal characteristics of the moving velocity of the carriage with respect to a position from start of movement of the carriage, wherein the controller is configured to determine whether to perform the separate driving, based on an integrated value of a difference between the moving velocity in a particular section in actual characteristics and the moving velocity in the particular section in the ideal characteristics, the particular section being an entirety or a part of a section in which the carriage accelerates from start of movement.

11. The image recording apparatus according to claim 1, wherein the drive target is a conveyance motor configured to transmit driving force to a roller that conveys a sheet to a position facing the recording head so as to rotate the roller.

12. The image recording apparatus according to claim 1, wherein the controller includes:

a first driving circuit configured to control one of a voltage applied from the power supply to the drive target and a current that is supplied from the power supply to the drive target; and a second driving circuit configured to control one of a voltage applied from the power supply to the carriage motor and a current that is supplied from the power supply to the carriage motor, the second driving circuit including a current limiting circuit configured to cut the part of the second driving current.

13. The image recording apparatus according to claim 12, wherein the first driving circuit is a current control circuit.

14. The image recording apparatus according to claim 12, wherein the second driving circuit is a voltage control circuit.

15. The image recording apparatus according to claim 1, further comprising a velocity sensor configured to detect a moving velocity of the carriage, wherein the controller is configured to:

switch a mode of driving the drive target and the carriage motor between a first mode in which the drive target and the carriage motor are not driven simultaneously, and a second mode in which the drive target and the carriage motor are driven simultaneously;

determine whether an overshoot is significant where the moving velocity of the carriage is larger than the moving velocity in ideal characteristics after the carriage shifts from an acceleration state to a constant-velocity state;

in response to determining that the overshoot is significant, drive the drive target and the carriage motor in the first mode; and in response to determining that the overshoot is not significant, drive the drive target and the carriage motor in the second mode.

16. The image recording apparatus according to claim 1, wherein the drive target is a conveyance motor.

* * * * *